US006216793B1

(12) United States Patent
Sundholm

(10) Patent No.: US 6,216,793 B1
(45) Date of Patent: Apr. 17, 2001

(54) INSTALLATION FOR EXTINGUISHING FIRE

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

(21) Appl. No.: 09/535,386

(22) Filed: Mar. 24, 2000

(30) Foreign Application Priority Data

Oct. 8, 1999 (FI) ..... 19992172
Oct. 19, 1999 (FI) ..... 19992257
Oct. 26, 1999 (FI) ..... 19992312

(51) Int. Cl.[7] ..... A62C 37/00

(52) U.S. Cl. ..... 169/54; 169/16; 169/37; 169/62

(58) Field of Search ..... 169/16, 37, 62, 169/54, 55, 64; 239/548, 556, 559

(56) References Cited

U.S. PATENT DOCUMENTS 4,091,876 * 5/1978 Valdatta ..... 169/62
4,989,675 * 2/1991 Papavergos ..... 169/37 X
5,040,611 * 8/1991 Steel ..... 169/62
5,808,541 * 5/1978 Golden ..... 169/62 X

* cited by examiner

*Primary Examiner*—Patrick Brinson
*Assistant Examiner*—Steven J. Ganey
(74) *Attorney, Agent, or Firm*—Ladas and Parry

(57) ABSTRACT

The invention relates to an installation for extinguishing fire in a railway carriage for transportation of lorries, trailers and the like. In order to extinguish a fire efficiently in a trailer or the like, the installation comprising at least two spray heads (1, 2), whereof the first spray head (1) is placed in the railway carriage close to a first longitudinal side wall (3) of the railway carriage and obliquely directed downwards at an angle ($\alpha 1$) of 40 to 70° in relation to a vertical plane, and the second spray head (2) is placed in the railway carriage close to a second longitudinal side wall (4) of the railway carriage opposite the first side wall and obliquely directed downwards at an angle ($\alpha 2$) of 40 to 70° in relation to the vertical plane, the spray heads being placed at a height of 3,2 to 4 m above the railway carriage floor (11) and arranged to spray water-based extinguishing medium at a spread angle ($\beta 1$, $\beta 2$) of 45 to 120°.

12 Claims, 2 Drawing Sheets

INSTALLATION FOR EXTINGUISHING FIRE

BACKGROUND OF THE INVENTION

The invention relates to an installation for extinguishing fire in a railway carriage for transportation of lorries, trailers and the like. The invention also relates to an installation for extinguishing fire in a tunnel, preferably in a car or train tunnel.

Railway carriages transporting vehicles, such as lorries and trailers, are rarely equipped with fire extinguishing installations; the reason being the problematic surroundings for fire extinguishing installations. One problem is to extinguish a fire that starts inside a covered trailer transported by the railway carriage. The fire is very difficult to extinguish, since the top of the trailer is covered, typically with an aluminium cover, and the sides of the trailer are covered with a tarpaulin preventing the extinguishing medium from being sprayed from the outer side of the trailer into the goods space of the trailer. Owing to the above the goods that have caught fire have plenty of time to burn, and the fire may rapidly spread far, before the extinguishing medium is delivered to the fire area. If extinguishing medium is sprayed towards the side surfaces of the tarpaulin, said surfaces will only be cooled and protect the tarpaulin from burning, while the goods inside the tarpaulin can unimpededly continue to burn.

Car tunnels are another problematic environment for extinguishing fire, which is why fire extinguishing installations are seldom installed therein. As regards fire extinguishing a similar problem to the one with railway carriage transportation arises when trailers and the like are transported in tunnels. Consequently, a possible fire extinguishing installation is rarely capable of preventing the goods in the trailer from burning.

BRIEF DESCRIPTION OF THE INVENTION

It is an object of the present invention to efficiently extinguish fire in trailers and the like when these are transported in railway carriages. Another object of the invention is to efficiently extinguish fire in trailers and railway carriages when these travel through tunnels.

Said first object is achieved with an installation for extinguishing fire in a railway carriage for transportation of lorries, trailers and the like, the installation comprising at least two spray heads, whereof the first spray head is placed in the railway carriage close to a first longitudinal side wall of the railway carriage and obliquely directed downwards at an angle of 40 to 70° in relation to a vertical plane, and the second spray head is placed in the railway carriage close to a second longitudinal side wall of the railway carriage opposite the first side wall and obliquely directed downwards at an angle of 40 to 70° in relation to the vertical plane, the spray heads being placed at a height of 3.2 to 4 m above the railway carriage floor and arranged to spray water-based extinguishing medium at a spread angle of 45 to 120°.

The preferred embodiments of the invention are disclosed in the attached claims 1 to 11.

Said second object is achieved with an installation for extinguishing fire in a tunnel, preferably in a car or train tunnel, the installation comprising at least two spray heads, whereof the first spray head is placed close to a first longitudinal side wall of the tunnel and obliquely directed downwards at an angle of 40 to 70° in relation to a vertical plane, and the second spray head is placed close to a second longitudinal side wall of the tunnel opposite the first side wall and obliquely directed downwards at an angle of 40 to 70° in relation to the vertical plane, the spray heads being placed at a height of 3.2 to 4 m above the floor level of the tunnel and arranged to spray water-based extinguishing medium at a spread angle of 45 to 120°.

The invention is based on the idea to place the spray heads on such a location in relation to the trailer that the spray heads, when activated, immediately spray extinguishing medium into the trailer after the fire has burnt holes on the tarpaulin, whereby the extinguishing medium is sprayed or injected through the hole, and the spray heads are then positioned so that they, on one hand, are directed towards the goods in the trailer for putting out the fire and, on the other hand, so that they are placed so high up that, when functioning, they suck heat from the hot flue gases, which speeds up the vaporization of the water-based extinguishing medium used in the installation, whereby the area immediately above the fire is rapidly cooled down. By selecting a wide spread angle some of the extinguishing medium can be delivered into the areas where hot gas zones exist, thus preventing the flue gases from rapid and sudden ignition.

BRIEF DESCRIPTION OF THE DRAWINGS

In the following the invention will be described in greater detail by means of two embodiments with reference to the accompanying drawing, in which.

DETAILED DESCRIPTION OF THE INVENTION

Figure 1:
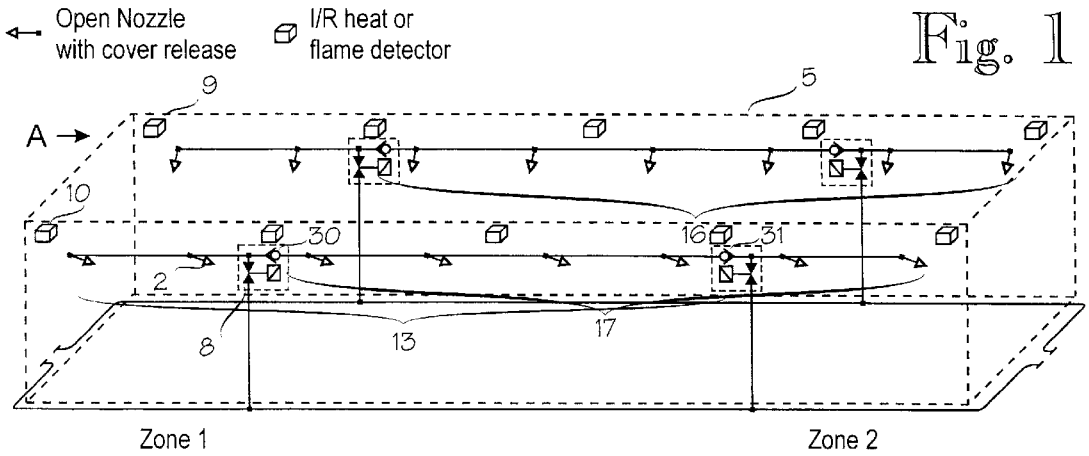
FIG. 1 is a side view showing a fire extinguishing installation of the invention in a railway carriage.
Figure 2:
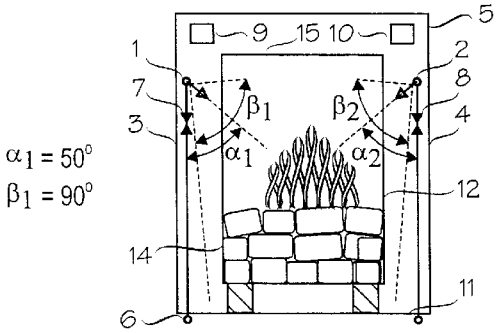
FIG. 2 shows the installation in FIG. 1 in the direction of arrow A and with a trailer.
Figure 3:
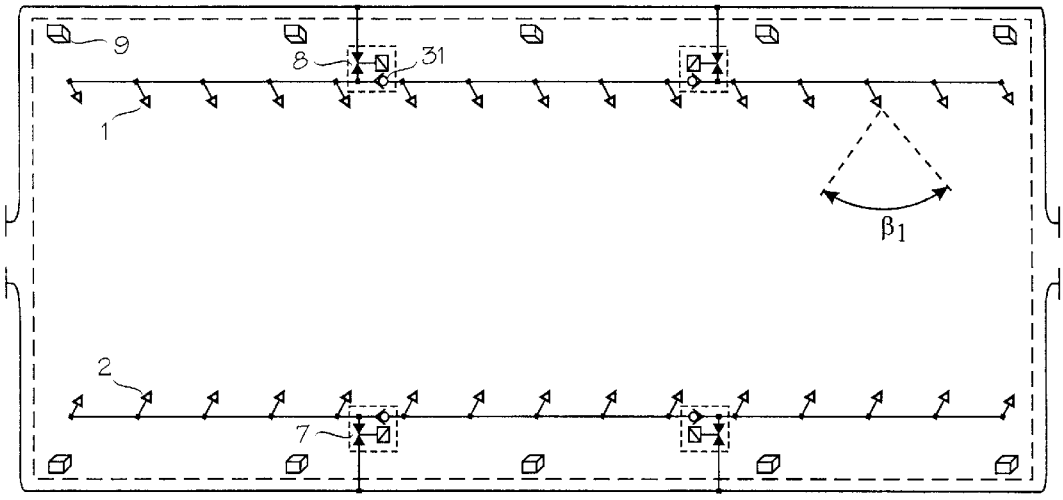
FIG. 3 is a top view showing the installation in FIG. 1, FIGS. 4 to 6 are corresponding views to FIG. 2 showing different spray head locations.
Figure 8:
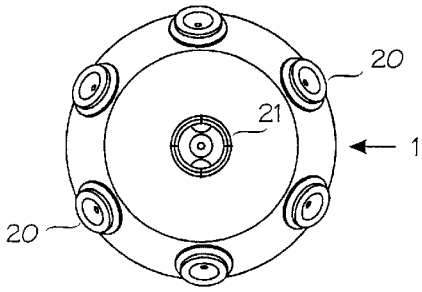
FIG. 8 is a front view showing a spray head that can be used in the installation of the invention.

FIGS. 1 and 2 show a railway carriage 5 with a fire extinguishing installation comprising several spray heads 1, 2 mounted along and close to both side walls 3, 4 of the railway carriage. Reference numeral 6 refers to a pipe system for providing extinguishing medium in the form of water-based liquid through valves 7, 8 to the spray heads 1, 2. The spray heads 1, 2 are preferably of a type comprising several nozzles 20 including a central nozzle 21, see FIG. 8, and can at high working pressure of, for example, 20 to 200 bar produce extinguishing medium in the form of liquid mist with high penetration. The spray heads 1, 2 may preferably be constructed as presented in WO 92/20453. A number of detectors 9, 10 are placed at the ceiling level of the railway carriage. In case of fire these detectors 9, 10 provide a signal that opens the respective valves 7 and 8. Detector 9, for example, opens the valve 7, whereafter extinguishing medium can flow into the spray head 1.

The spray heads 1, 2 are obliquely directed downwards at an angle $\alpha 1$ of 50° in relation to the railway carriage floor 11. The angle of departure, i.e. the spread or output angle $\beta 1 = \beta 2$ of the spray heads 1, 2 is 90°. The spray heads 1, 2 are placed at a height of 3.5 m above the floor 11.

Reference numeral 12 refers to a trailer with an aluminium cover and a tarpaulin of plastic material. The tarpaulin covers the sides 3, 4 of the trailer 12.

If a fire starts in the trailer 12, the fire continues until a hole appears in the tarpaulin. As the heat from the fire is directed upwards, the hole caused by the fire always appears at the top of the tarpaulin, close to the trailer ceiling 15. When fire is detected, the respective valve is provided with a signal. If, for example, the detector 10 detects the fire, the detector provides the valve 8 with a signal so as to open it, and extinguishing medium can flow into and out from the spray heads 2 in a fire extinguishing zone 13. A check valve 31 prevents the extinguishing liquid from flowing to the last five spray heads on the right, which are part of an adjacent fire extinguishing zone 17. One or more of the spray heads 2 thus spray extinguishing medium mist obliquely downwards towards the burning goods 14. A central extinguishing medium jet forms the angle $\alpha 1=50°$ with a vertical side plane. This jet suppresses the fire and rapidly cools the location of the fire by vaporizing the extinguishing medium. The vaporization occurs rapidly, since hot flue gases are present around the spray heads and these hot gases are sucked into the extinguishing medium jet that is directed towards the seat of fire. Owing to the wide spread angle $\beta 1=\beta 2$, a part of the extinguishing medium is sprayed almost directly downwards to a lower peripheral area in order to cool the tarpaulin/the goods. Another part of the extinguishing medium is sprayed almost horizontally towards the tarpaulin into an upper peripheral area in the vicinity of the trailer ceiling 15. The last-mentioned part prevents the flue gases from rapid and sudden ignition and prevents the fire from spreading to other zones, like zone 16 in the railway carriage.

Figure 4:
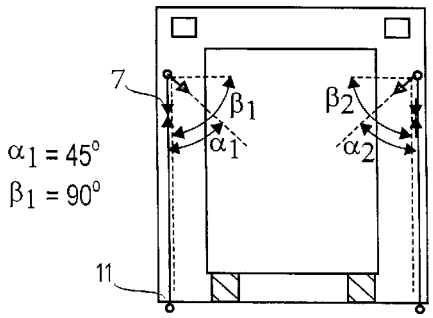
Figure 5:
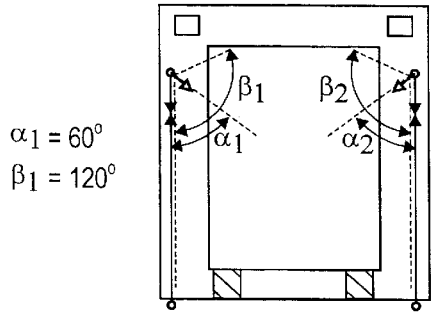
Figure 6:
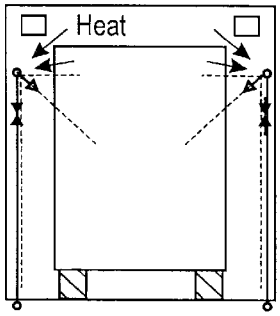

FIGS. 4 to 6 show alternative spray and spread angles to the ones in FIG. 2 for the spray heads. The angle $\alpha 1$ in relation to the vertical plane ranges from 40 to 70°, preferably from 45 to 60°. The spread angle $\beta 1$, $\beta 2$ ranges from 45 to 120°, preferably from 90 to 120°.

The height of the spray heads 1, 2 above the floor 11 ranges from 3.2 to 4 m.

Figure 7:
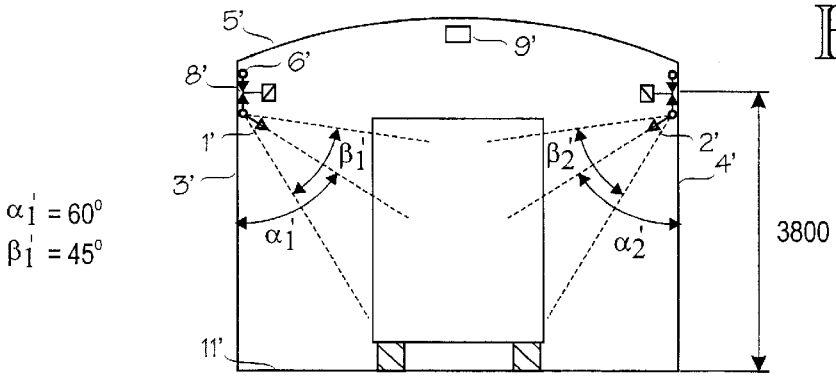
FIG. 7 shows the installation of the invention in a tunnel.

FIG. 7 shows a fire extinguishing installation according to the invention mounted in a car tunnel 5'. Alternatively the tunnel could also be a train tunnel. The spray heads 1', 2' are placed along the side walls 3', 4' of the tunnel in the same way as in the railway carriage in FIG. 1. The spray heads 1', 2' are placed at an angle $\alpha'1$, and $\alpha'2$ respectively, which is 60° in relation to a vertical plane. It is assumed that the angles $\alpha'1$, $\alpha'2$ ranging from 40 to 70° and preferably from 45 to 60° provide good results in view of fire extinguishing. An appropriate angle depends on the height of the spray heads 1', 2' above the floor level 11' of the tunnel and on their distance from the object, i.e. the vehicle/trailer/goods that is to be protected in case of fire. The spread angle $\beta 1$, $\beta 2$ is 45°, and is narrow compared with the spread angle in FIGS. 1 to 6. This is due to the fact that the tunnel 5' is wide in relation to the width of the railway carriage in FIGS. 1 to 6, whereby the distance of the spray heads 1', 2' from the object that is to be protected exceeds the one shown in FIGS. 1 to 6. It is assumed that in a tunnel the spread angles $\beta 1$, $\beta 2$ ranging from 45 to 120° and here preferably from 90 to 120° provide good results.

The invention has above been described only with reference to examples and it is therefore pointed out that the details of the invention may vary in many ways within the scope of the attached claims.

I claim:

1. An installation for extinguishing fire in a railway carriage, the installation comprising at least two spray heads (1, 2), whereof the first spray head (1) is placed in the railway carriage close to a first longitudinal side wall (3) of the railway carriage and obliquely directed downwards at an angle ($\alpha 1$) of 40 to 70° in relation to a vertical plane, and the second spray head (2) is placed in the railway carriage close to a second longitudinal side wall (4) of the railway carriage opposite the first side wall and obliquely directed downwards at an angle ($\alpha 2$) of 40 to 70° in relation to the vertical plane, the spray heads being placed at a height of 3.2 to 4 m above the railway carriage floor (11) and arranged to spray water-based extinguishing medium at a spread angle ($\beta 1$, $\beta 2$) of 45 to 120°.

2. An installation as claimed in claim 1, wherein the spray heads (1, 2) are at least mainly directed against each other, and are thus arranged to spray away from the respective side wall (3, 4) close to which the spray heads are placed.

3. An installation as claimed in claim 1, wherein the spray heads (1, 2) are directed at an angle ($\alpha 1$, $\alpha 2$) of 45 to 60° in relation to the vertical plane.

4. An installation as claimed in claim 1, wherein the spray heads (1, 2) are placed at a height of 3.4 to 3.8 m above the railway carriage floor (11).

5. An installation as claimed in claim 1, wherein the spray heads (1, 2) are arranged to spray at a spread angle ($\beta 1$, $\beta 2$) of 90 to 120°.

6. An installation as claimed in claim 1, wherein the spray heads (1, 2) are arranged to deliver extinguishing medium in an area extending from a lower peripheral area, which mainly extends straight downwards towards the railway carriage floor (11), to an upper peripheral area, which mainly extends horizontally regarding the railway carriage floor.

7. An installation as claimed in claim 6, wherein the upper peripheral area extends maximally about 30° upwards regarding the floor level.

8. An installation as claimed in claim 6, wherein several spray heads (1, 2) extending in the longitudinal direction of the railway carriage are placed along both side walls (3, 4) of the railway carriage.

9. An installation as claimed in claim 1, wherein the spray head (1, 2) is of a type which at high pressure provides a mist-like spray with high penetration by forming a suction at the spray head, the spray head comprising several nozzles (20, 21) placed and directed in order to obtain penetration.

10. An installation as claimed in claim 9, wherein the spray head (1) comprises a central nozzle (21) which is surrounded by a plurality of obliquely placed nozzles (20).

11. An installation as claimed in claim 1, wherein the area close to the side walls (3, 4) of the railway carriage at a height of 0.5 to 3 m is free from spray heads.

12. An installation for extinguishing fire in a tunnel, the installation comprising at least two spray heads (1', 2'), whereof the first spray head (1') is placed close to a first longitudinal side wall (3') of the tunnel and obliquely directed downwards at an angle ($\alpha'1$) of 40 to 70° in relation to a vertical plane, and the second spray head (2') is placed close to a second longitudinal side wall (4') of the tunnel opposite the first side wall and obliquely directed downwards at an angle ($\alpha'2$) of 40 to 70° in relation to the vertical plane, the spray heads being placed at a height of 3.2 to 4 m above the floor level (11') of the tunnel and arranged to spray water-based extinguishing medium at a spread angle ($\beta 1$, $\beta 2$) of 45 to 120°.

* * * * *